US005642716A

United States Patent [19]

Ricco

[11] Patent Number: 5,642,716

[45] Date of Patent: Jul. 1, 1997

[54] DEVICE FOR REGULATING THE SUPPLY OF PRESSURIZED FLUID TO A PRESSURIZED FLUID ACCUMULATOR, FOR EXAMPLE FOR MOTOR VEHICLES

[75] Inventor: Mario Ricco, Via Ferrannini, Italy

[73] Assignee: Elasis Sistema Ricerca Fiat Nel Mezzogiorno Societe Consortile Per Azioni, Italy

[21] Appl. No.: 622,072

[22] Filed: Mar. 26, 1996

[30] Foreign Application Priority Data

Mar. 28, 1995 [IT] Italy ..... TO95A0240

[51] Int. Cl.[6] ..... F02M 41/00

[52] U.S. Cl. ..... 123/456; 123/447; 123/514

[58] Field of Search ..... 123/456, 506, 123/458, 497, 514, 179.17

[56] References Cited

U.S. PATENT DOCUMENTS

| | | | |
|---|---|---|---|
| 4,872,438 | 10/1989 | Ausiello | 123/510 |
| 5,085,193 | 2/1992 | Morikawa | 123/497 |
| 5,094,216 | 3/1992 | Miyaki | 123/506 |
| 5,373,829 | 12/1994 | Schuers | 123/514 |
| 5,425,342 | 6/1995 | Agira | 123/514 |
| 5,433,182 | 7/1995 | Augustin | 123/456 |
| 5,456,233 | 10/1995 | Felhofer | 123/456 |

*Primary Examiner*—Carl S. Miller
*Attorney, Agent, or Firm*—Graham & James LLP

[57] ABSTRACT

The device comprises a pressure pump for pumping fuel from a reservoir to a pressure duct connected to an accumulator. This supplies a series of injectors for an internal combustion engine. The device further includes a pair of solenoid valves disposed between the pump and the accumulator, which are controlled by an electronic unit as a function of data on the pressure in the accumulator detected by a sensor. The solenoid valve is normally closed to discharge fuel received from the pump into the reservoir and is opened to deliver this fuel to the accumulator. On the other hand the solenoid valve is normally open to deliver fuel received to the accumulator and is closed to discharge the fuel from the accumulator into the reservoir. Between the two solenoid valves and is disposed a non-return valve.

9 Claims, 2 Drawing Sheets

DEVICE FOR REGULATING THE SUPPLY OF PRESSURIZED FLUID TO A PRESSURIZED FLUID ACCUMULATOR, FOR EXAMPLE FOR MOTOR VEHICLES

BACKGROUND OF THE INVENTION

The present invention relates to a device for regulating the pressure at which a pressurised fluid is supplied to an accumulator, for example for motor vehicles. In particular the regulation device is applied in a fuel supply system for an internal combustion engine.

Pressure regulation devices for a fluid supplied by a pressurisation pump to a container are known, in particular for the pressurised fuel supply of an engine. In a known device the control loop is effected by means of a pressure regulating solenoid valve the winding of which is excited with a variable current corresponding to the desired pressure for the purpose of discharging excess fuel.

Since the capacity of the high pressure fuel pump for the accumulator is constant it is in general dimensioned in such a way as to obtain pressure and flow rate values required over a wide range of speed of rotation of the pump itself, which is directly related to the speed of the engine. Therefore, in certain operating conditions, for example at maximum speed but with low power, the flow rate of the pump is over abundant. This device therefore has the disadvantage of dissipating a part of the work done in compression as heat through the pressure control valve, which reduces the pressure of the fuel from the high pressure existing in the accumulator to atmospheric pressure.

SUMMARY OF THE INVENTION

The object of the invention is that of providing a pressure control device for a fluid supply, which will be of maximum simplicity and operational reliability and which will eliminate the above-listed disadvantages of known devices.

This object is achieved by a control device according to the invention which comprises a pressure pump for supply of the said fluid to the said accumulator, at least one element connected to the said accumulator operable to utilise the said fluid, and valve means operable to regulate the pressure of the said fluid in the said accumulator, and is characterised by the fact that the said valve means are able to regulate the flow of the said fluid towards the said accumulator, a pressure sensor being provided to detect the pressure of the fluid in the said accumulator and to condition automatic control means in such a way as to control the operation of the said valve means as a function of the thus-detected pressure of the said fluid.

BRIEF DESCRIPTION OF THE DRAWINGS

For a better understanding of the invention a preferred embodiment is described herein by way of example with the aid of the attached drawings, in which.

DETAILED DESCRIPTION OF THE INVENTION

Figure 1:
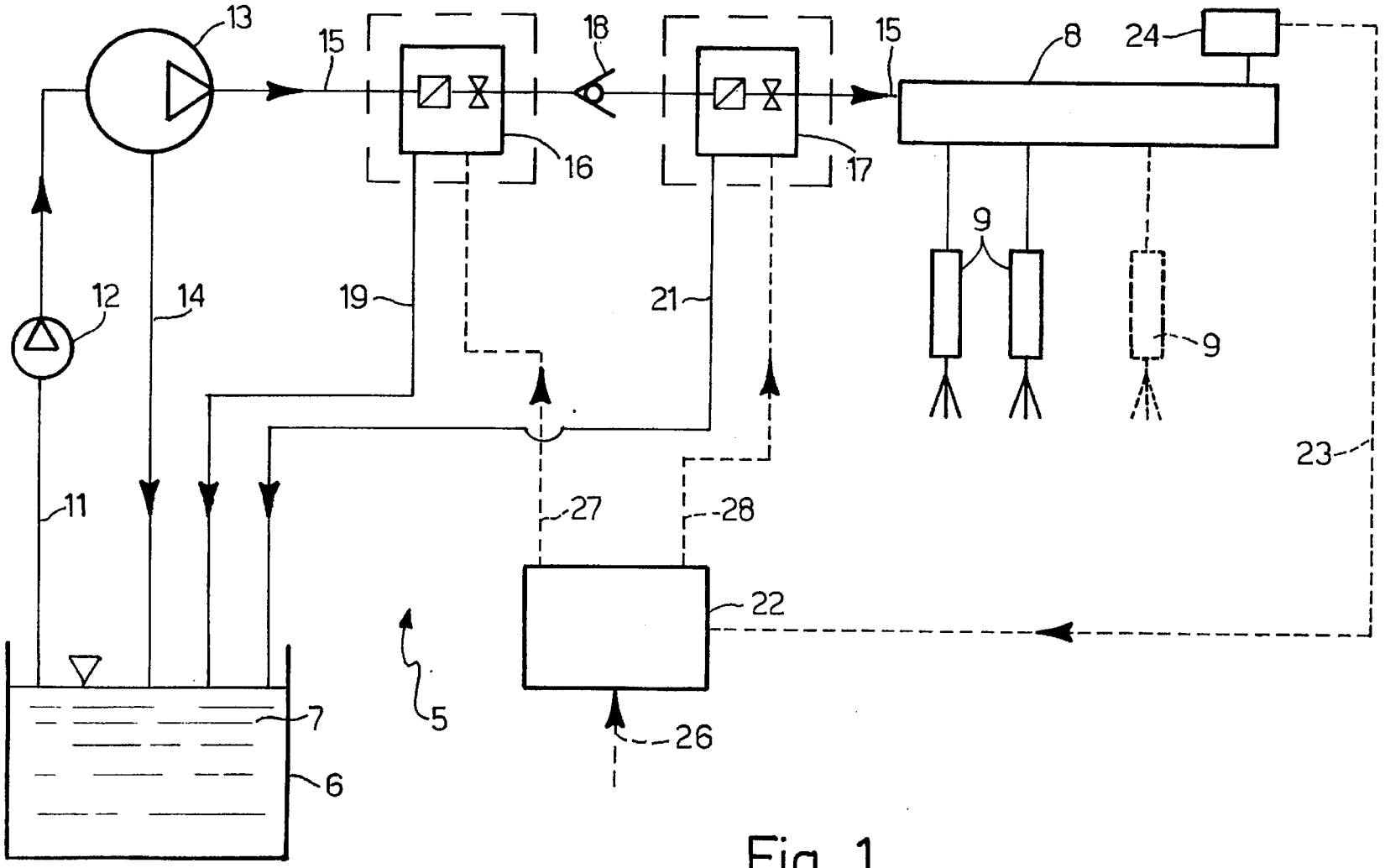
FIG. 1 is a diagram of a device for controlling the pressure of a fluid in an accumulator according to the invention.

With reference to FIG. 1, the reference numeral 5 generally indicates a fuel supply system of a motor vehicle internal combustion engine. The system 5 comprises a reservoir 6 for the fuel 7 at atmospheric pressure and accumulator 8 for containing the fuel 7 at high pressure, at which the engine is supplied. The accumulator 8 is connected to injectors 9 in turn connected to corresponding cylinders of the engine. The injectors 9 are electromagnetically controlled, at a frequency corresponding to the speed of rotation of the engine, to inject a predetermined quantity of fuel into the cylinders.

The reservoir 6 is provided with an outlet duct 11 having pump means comprising a low pressure pump 12 and a high pressure pump 13 which is positioned downstream of the pump 12 and is supplied by this latter. The high pressure pump 13 is connected to the reservoir 6 by means of a discharge duct 14 for excess pumped fuel, for example for the purpose of lubricating and/or cooling the moving parts of the pump 13.

Moreover the pump 13 is connected to the accumulator 8 by means of a high pressure duct 15 in which are disposed valve means. These valve means include a first solenoid valve 16, a second solenoid valve 17 disposed between the first solenoid valve 16 and the accumulator 8, and a non-return valve 18 disposed between the two solenoid valves 16 and 17.

The two solenoid valves 16 and 17 are connected to the reservoir 6 each by means of a corresponding discharge duct 19 and 21. They can be of any known type and are able to assume a totally open condition, in which they allow the delivery of fuel along the duct 15 towards the accumulator 8, or a totally closed condition in which fuel is discharged from the duct 15 through ducts 19 and 21 into the reservoir 6. Therefore the solenoid valves 16 and 17 have a constant flow rate and can therefore be manufactured economically.

The solenoid valves 16 and 17 are actuated under the control of an automatic electronic control unit 22 preferably including a digital data processing unit not illustrated. In particular, the solenoid valve 16 is normally closed and is opened when it is actuated by the unit 22. On the other hand the solenoid valve 17 is normally open and is closed when it is actuated by the unit 22.

The electronic unit 22 is connected via a conductor 23 to a pressure sensor 24 which is positioned on the accumulator 8 and is able to detect the pressure P of the pressurised fuel in the accumulator 8 and to send corresponding signals or data to the unit 22. This unit 22, therefore, effects a feedback or closed "loop" control.

The unit 22 is further able to receive, on an input 26 and in a manner known per se, other date relating to the instantaneous speed of rotation of the engine. The unit 22 is operable to process the data received from the sensor 24 and/or through the input 26, and to emit control signals for the solenoid valves 16 and 17, which signals are transmitted through two corresponding conductors 27 and 28.

The control device operates in the following manner.

Figure 2:
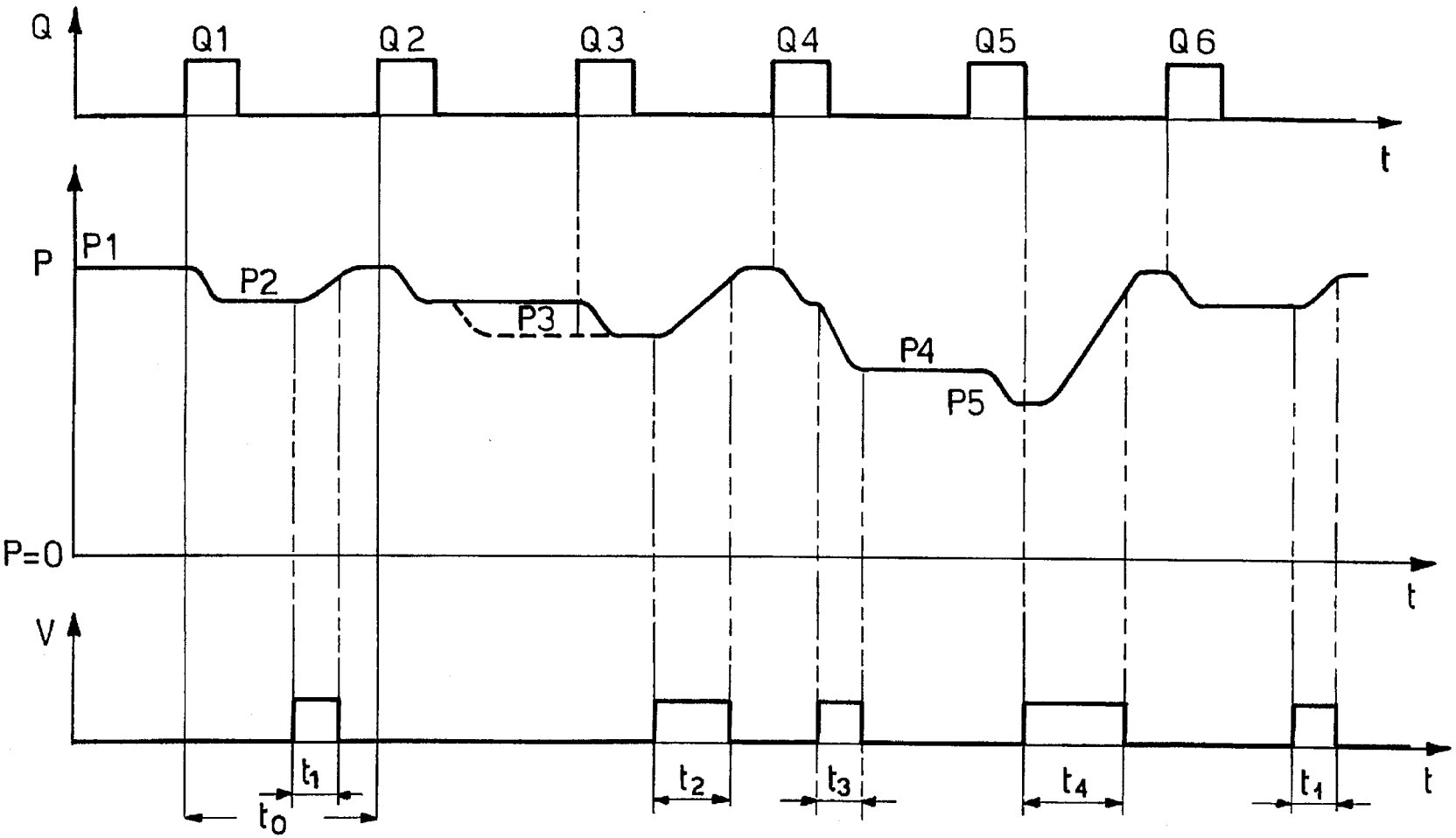
FIG. 2 is a diagram illustrating the operation of the device of FIG. 1.

In the diagram of FIG. 2 are shown the periods Q1–Q6 in which the various injectors 9 cyclically withdraw fuel under pressure from the accumulator 8 to inject it into corresponding cylinders of the engine. The time interval between one injection and the next is indicated t0.

First, supposing that the pressure P of the fuel required for a given speed of rotation of the engine has a predetermined value P1. In the absence of withdrawal of fuel from the accumulator 8 the solenoid valve 16 is closed whilst the solenoid valve 17 is open. In this case the fuel pumped by the pump 13 is discharged into the reservoir 6 through the duct 19, whilst the non-return valve 18 prevents discharge of fuel from the accumulator 8 and the valve 17 towards the valve 16.

At an injection of fuel the fuel pressure P in the accumulator 8 experiences a reduction bringing the predetermined value P1 to the value P2. This pressure reduction is signalled by the sensor 24 to the unit 22 which consequently controls the actuation of the solenoid valve 16. In particular this latter is opened and maintained in this position until the predetermined pressure P1 is reestablished in the accumulator 8 after a time t1.

If, instead of the predetermined value P2, a threshold value P3 is chosen, the unit 22 in response to the information on the reduction of fuel pressure in the accumulator 8, received from the sensor 24, controls the actuation of the solenoid valve 16 for a time t2 greater than the above-mentioned time t1 thus taking the pressure in the accumulator 8 to the value P1.

Supposing now that the unit 22 receives at its input 26 a signal requiring a pressure reduction in the accumulator 8 to a value P4. In this case the unit 22 emits a signal for control of the actuation of the solenoid valve 17 which is closed for a time t3 thereby discharging part of the fuel 7 from the accumulator 8 until the pressure in the accumulator 8 reaches the value P4.

Following an injection of fuel taken from the accumulator 8, for example Q5, the pressure is now taken to a value P5 less than the value P4. If subsequently the unit 22 is asked to take the pressure to the value P1 it causes the solenoid valve 16 to open for a time t4 again greater than the time t2.

From what has been seen above the advantages of the pressure control device according to the invention over known devices are evident.

Above all the solenoid valves 16 and 17, being of constant flow rate, are of low cost to manufacture. Moreover their arrangement in the high pressure duct 15, and the control by means of the unit 22, allows the pressure in the accumulator 8 to be regulated without waste of compression work by the high pressure pump 13 and without the unwanted heating of the fuel which could require the installation of a heat exchanger in the engine fuel supply circuit.

It is understood that the control device described can have various modifications and improvements introduced thereto without departing from the ambit of the claims. For example the unit 22 could be programmed in such a way as to generate signals of duration corresponding to the pressure required from time to time in the accumulator 8, thus functioning as an open loop rather than a closed loop system.

I claim:

1. A device for controlling the pressure of a fluid supplied to a pressurised fluid accumulator (8), for example for rotor vehicles, comprising a pressurisation pump (13) for supply of the fluid to the accumulator (8); at least one element (9) connected to the accumulator (8) operable to utilise the fluid; and valve means (16, 18) operable to regulate the pressure of the fluid in the accumulator (8); wherein the valve means (16–18) is operable to regulate the flow of the fluid of the accumulator (8), with a pressure sensor (24) being provided to detect the pressure of the fluid in the accumulator (8) and to condition automatic control means (22) in such a way as to control actuation of the valve means (16–18) as a function of the thus-detected pressure of the fluid; wherein the fluid comprises the fuel in an internal combustion engine and the element comprises a fuel injector (9); the pump (3) being disposed in a duct (11, 15) between a fuel reservoir (6) and the accumulator (8); wherein the valve means (16–18) includes at least a first solenoid valve (16) disposed in a portion (15) of the duct (11, 15) disposed between the pump (13) and the accumulator (8); wherein the control means includes an electronic control unit (22) operable to control the actuation of the first solenoid valve (16); the pressure sensor (24) being operable to detect the pressure of the fuel in the accumulator (8) and to signal it to the unit (22); wherein the first solenoid valve (16) normally discharges pumped fuel into the reservoir (6); the first solenoid valve (16) being actuated to supply the pumped fuel to the accumulator (8) until the pressure thereof is reestablished, and wherein the valve means (16–18) includes a second solenoid valve (17) disposed in the portion (15) of the duct (11–15) between the first solenoid valve (16) and the accumulator (8), the second solenoid valve (17) also being actuated under the control of the unit (22); and with a non-return valve (18) being provided between the two solenoid valves (16–17).

2. A device according to claim 1, characterised by the fact that the said first and second solenoid valves (16, 17) are actuated under the control of the said unit (22) in response to different pressure values detected by the said sensor (24).

3. A device according to claim 1, characterised by the fact that the said second solenoid valve (17) normally supplies the said accumulator (8) with the fuel received through the said non-return valve (18) and is actuated such that fuel received is discharged to the said reservoir (6) to reduce the pressure of the fuel in the said accumulator (8).

4. A device for controlling the pressure of a fluid supplied to a pressure fluid accumulator (8); said device comprising a pressurisation pump (13) for supplying pressurised fluid to said accumulator (8), with at least one element (9) being connected to said accumulator (8) and operable for utilising said pressurised fluid; a duct portion (15) between said pump (13) and said accumulator (8); valve means (16–18) arranged in said duct portion (15); a pressure sensor (24) for detecting the pressure of the fluid in said accumulator (8); and automatic control means (22) controlled by said sensor (24) for operating said valve means (16–18) as to regulate the flow of said fluid to said accumulator (8) according to the so detected pressure; wherein said valve means (16–18) comprise a pair of solenoid valves (16, 17) located in series in said duct portion (15), and a non-return valve (18) positioned between said solenoid valves (16, 17); with said solenoid valves (16, 17) being selectively operated by said control means (22).

5. The device according to claim 4, wherein said fluid is the fuel of an internal combustion engine of a motor vehicle, wherein said at least one element comprises a fuel injector (9) for an internal combustion engine, wherein said pump (13) is connected to a first one of said solenoid valves (16, 17) and to a second duct portion (11), which second duct portion is connected to a fuel reservoir (6), with each one of said solenoid valves (16, 17) being connected to said reservoir (6) by a corresponding discharge duct (19, 21).

6. The device according to claim 5, wherein said control means (22) is adapted to cause said solenoid valves (16, 17) to be opened one at a time, with one of said solenoid valves (16, 17) being opened for increasing the fuel pressure in said accumulator (8), and the other of said solenoid valves (16, 17) being opened for decreasing the fuel pressure in said accumulator (8).

7. The device according to claim 6, wherein said control means includes an electronic control unit (22) adapted to be controlled by signals representative of the speed of rotation of said engine, said solenoid valves (16, 17) permitting a constant flow rate and said solenoid valves being able to assume either of a totally open condition or a totally closed position.

8. A device according to claim 7, characterised by the fact that the said control unit includes a digital data processor unit (22) and is operable to provide control signals of variable duration.

9. A device according to claim 1, characterised by the fact that the said processor unit (22) is adapted to receive at one of its inputs (26) data on the speed of rotation of the said engine.

* * * * *

UNITED STATES PATENT AND TRADEMARK OFFICE

CERTIFICATE OF CORRECTION

PATENT NO. : 5,642,716
DATED : July 1, 1997
INVENTOR(S) : Mario Ricco

It is certified that error appears in the above-identified patent and that said Letters Patent is hereby corrected as shown below:

Title page, item [75] change "Via Ferannini" to --- Bari ---.

Item [73] change "Societe" to --- Societa ---.

Item [73] before "Italy" insert --- Pomigliano d'Arco, ---.

Signed and Sealed this

Sixteenth Day of December, 1997

Bruce Lehman

*Attest:*

BRUCE LEHMAN

*Attesting Officer*

*Commissioner of Patents and Trademarks*